United States Patent [19]

Bothner

[11] Patent Number: 4,571,071

[45] Date of Patent: Feb. 18, 1986

[54] CLEANING APPARATUS AND METHOD FOR A POLYCHROMATIC ELECTROPHOTOGRAPHIC COPIER

[75] Inventor: Carl R. Bothner, Rochester, N.Y.

[73] Assignee: Eastman Kodak Company, Rochester, N.Y.

[21] Appl. No.: 599,915

[22] Filed: Apr. 13, 1984

[51] Int. Cl.[4] ..... G03G 21/00

[52] U.S. Cl. ..... 355/15; 355/4; 430/125; 430/45; 118/652

[58] Field of Search ..... 355/15, 4, 77, 14 R; 118/652, 645, 652; 430/125, 45

[56] References Cited

U.S. PATENT DOCUMENTS

| | | | |
|---|---|---|---|
| 3,580,673 | 5/1971 | Yang | 355/15 |
| 3,780,391 | 12/1973 | Leenhouts . | |
| 3,788,454 | 1/1974 | Emerson . | |
| 3,900,003 | 8/1975 | Sato et al. . | |
| 3,910,231 | 10/1975 | Inoue et al. . | |
| 3,910,232 | 10/1975 | Kondo et al. . | |
| 4,006,987 | 2/1977 | Tomono et al. . | |
| 4,116,555 | 9/1978 | Young et al. . | |
| 4,218,131 | 8/1980 | Ito et al. . | |
| 4,251,154 | 2/1981 | Russel . | |
| 4,277,003 | 7/1981 | Tabuchi et al. . | |
| 4,351,604 | 9/1982 | Karasawa et al. . | |
| 4,402,103 | 9/1983 | Yanagawa et al. . | |
| 4,449,475 | 5/1984 | Schinke | 118/645 |
| 4,466,379 | 8/1984 | Nishimura | 118/656 |

FOREIGN PATENT DOCUMENTS

| | | |
|---|---|---|
| 3022774 | 2/1981 | Fed. Rep. of Germany . |
| 3231446 | 3/1983 | Fed. Rep. of Germany . |
| 2095133 | 9/1982 | United Kingdom . |

OTHER PUBLICATIONS

Xerox Disclosure Bulletin, vol. 7, No. 4, Jul./Aug. 1982, (Stamford, U.S.), J. R. Lainy, pp. 261-262.

Research Disclosure, No. 245, Sep. 1984, Havant, Hampshire, GB "Cleaning Apparatus".

*Primary Examiner*—R. L. Moses
*Assistant Examiner*—David S. Warren
*Attorney, Agent, or Firm*—Herman J. Strnisha

[57] ABSTRACT

A cleaning apparatus and method for removing residual toner from a photoconductor in a color copier. The apparatus includes a magnetic brush for removing color toner particles from the photoconductor as the different color toner particles serially appear at the cleaning station. A detoning roller located proximate the magnetic brush has a portion thereof near the magnetic brush electrically biased to strip charged toner particles from the brush. A plurality of skiving blades serially operate on the detoning roller in accordance with the respective color of the toner particles to remove the particles from the roller. The portion of the detoning roller adjacent the skiving blades is electrically biased to repel the particles to facilitate their removal. Each of the skiving blades is associated with a respective collecting means for collecting color toner particles of a respective color. When toner particles of one color are being removed from the roller, the skiving blades associated with the other colors are moved to a position where they assist in closing off their respective collecting means from receiving airborne toner particles of colors not intended to be collected. The toner particles collected by the cleaning apparatus are therefore sufficiently free of cross-contamination to permit recirculation to their respective developer stations.

27 Claims, 3 Drawing Figures

CLEANING APPARATUS AND METHOD FOR A POLYCHROMATIC ELECTROPHOTOGRAPHIC COPIER

BACKGROUND OF THE INVENTION

1. Field of the Invention

The present invention relates to a cleaning apparatus and method for removing colorant adhered to a surface, and more particularly to a cleaning apparatus and method that is adapted to separately collect the differently colored colorants that are removed from the surface with a minimum of cross-contamination of the collected colorants.

2. Description of the Prior Art

Electrophotography has enjoyed rapid growth as a convenient and efficient means for reproducing original documents. Most electrophotographic copiers produce black and white reproductions. These copiers, in general, operate by reproducing an electrostatic image of the document onto a charged photoconductor and developing this image at a developer station by dusting onto the photoconductor electroscopic opaque charged particles such as toner particles.

The toner particles selectively adhere to the charged areas in accordance with the electrostatic image and later these particles are transferred to a receiver sheet such as a sheet of paper, in the case of a plain-paper copier, to reproduce onto the paper the image of the original document. The particles are then fused onto the paper to provide a permanent copy of the original. While these copiers work well, there is a residue of particles which do not transfer to the paper and remain on the photoconductor. Most of these particles must be removed prior to the next copy cycle to ensure the quality of the next copy. To this end, cleaning apparatus such as brushes or skiving blades are provided for removing the particles and a vacuum may be provided for collecting the particles removed. Efficiency of the copier is enhanced and per copy cost reduced by recirculating these used toner particles back to the developer station for subsequent use.

Electrophotographic copiers producing multicolor copies are also known. In general, these employ a photoconductor, such as a drum or belt, upon which color separation images of the document to be reproduced are formed sequentially through different filters. Each image is developed on the photoconductor with a colorant such as an appropriate color toner and the toner image is then transferred to a receiver sheet. The sheet is recirculated in timed relation with the developed images on the photoconductor so that each color transfers accurately in superimposed register onto the sheet to form the multicolor copy. Before each image area on the photoconductor is returned to the exposure station for a subsequent exposure such as for reproduction of a different color image or a next copy cycle, residual toner particles remaining on the photoconductor are removed by a brush or other cleaning device. Most cleaning apparatus, particularly those incorporated in color copiers using dry toner particles, have in the past merely collected the residual toner particles for disposal. In U.S. Pat. No. 3,910,232, an apparatus is described for collecting colored developer particles and using intermingled colors as black or further mixing them with black developer particles for use as a black developer material. Since color toners for use in a multicolor electrophotographic processes are in general more expensive than black toners, it would be more desirable to recirculate collected residual toner particles to their original developer supplies rather than commingle them to produce a less valued product.

In U.S. Pat. Nos. 3,900,003 and 3,910,231, polychromatic electrophotographic copiers are described each of which include a developer station that causes differently colored liquid developers to be sequentially applied to a photoconductor. Excess liquid developer of each color flows onto a belt or roller. This excess developer is removed by skiving blades, each of which are associated with a respective color. Each of the blades is actuated in turn to remove its respective color developer. The differently colored liquid developers are collected and may be recirculated back to their respective developer supply tanks. While this may work well for removing liquid developers, the use of dry toner particles or colorants presents problems.

With the use of dry toner particles in copiers, there is a tendency for these particles to become entrained in air currents established by the moving parts of the machine. A problem is therefore presented of finding an efficient process and means for removing of colored particles from a surface and for collecting these particles by their respective colors with a minimum of contamination by airborne particles of other colors.

SUMMARY OF THE INVENTION

The invention pertains to an improved apparatus and method for removing colorants from a surface and for collecting same in collecting chambers. The invention is directed to a method and apparatus wherein colorant is removed from the surface and, while colorant of one color is being removed from the surface and collected in a respective collecting chamber, the collecting chambers for collecting colorants not currently being removed are sealed to block colorant of a color not associated with a collecting chamber from being collected therein.

BRIEF DESCRIPTION OF THE DRAWINGS

In the detailed description of the preferred embodiment of the cleaning apparatus of the invention reference is made to the accompanying drawings, in which.

DESCRIPTION OF THE PREFERRED EMBODIMENT

Because copier apparatus of the type described herein are well known, the present description will be directed in particular to elements forming part of or cooperating more directly with the present invention. Since the invention has particular utility with regard to a color copier, discussion will first be provided of an exemplary color copier to illustrate the environment in which the cleaning apparatus and method of the invention may be used. Thereafter discussion will be provided of a cleaning apparatus and method which comprises the preferred embodiment of the invention.

Figure 1:
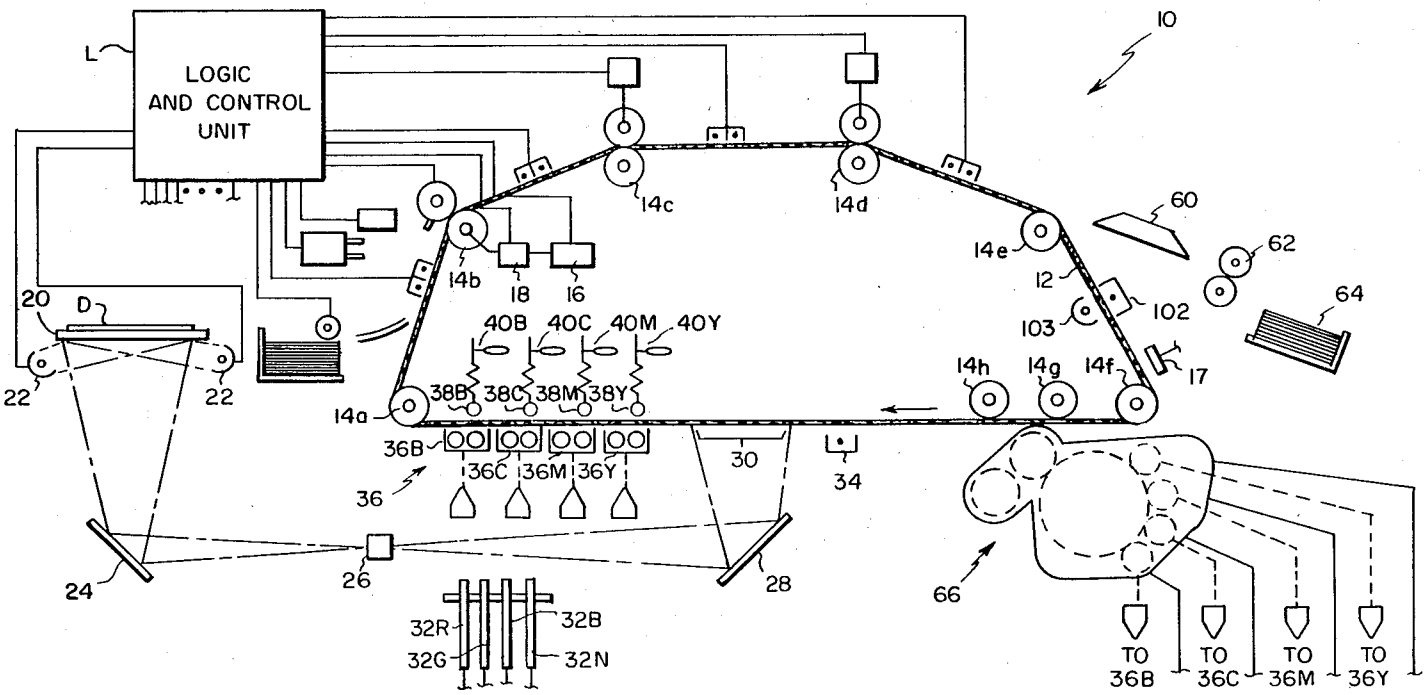
FIG. 1 is a schematic representation of a color copier including cleaning apparatus made in accordance with the invention.

With reference now to FIG. 1, an electrophotographic color copier 10 includes a closed loop, flexible image transfer member, or photoconductive web 12. The web 12, which may be of the type described in U.S. Pat. No. 3,615,414, issued Oct. 26, 1971 in the name of Light, is supported on rollers 14a–14h. The web comprises a photoconductive layer overlying a grounding or "Q" layer coated on an inactive support. Electrical connection with the grounding layer may be made by a wire brush in contact with a stripe coated adjacent the edge of the web. The rollers are mounted on the copier frame (not shown) with one of the rollers, for example roller 14b, rotatively driven by a motor 16 to effect continuous movement of the web 12 in a clockwise direction about its closed loop path. The web has a plurality of sequentially spaced, nonoverlapping image areas which pass successively through electrophotographic processing stations (charge, expose, develop, transfer, clean) located about the path of the web. The web also includes timing marks (or regularly spaced perforations) which are sensed by appropriate means, such as timing signal generator 17 to produce timing signals. Such signals are sent to a logic and control unit L, such as a Model 8080 microcomputer available from Intel Corp. of Santa Clara, Calif. The unit L controls the entire electrophotographic process based on the instantaneous location of the web in the travel path. An encoder 18 associated with the roller drive motor 16 also produces timing signals for the logic and control unit L. The signals from the encoder cause the unit L to fine tune the process timing.

A multicolored original document D to be reproduced is placed, image side down, on a transparent glass platen 20 supported by the copier frame. Exposure lamps 22, such as xenon flash tubes, are located beneath the platen 20 within the frame. The lamps flood the document with light and a reflected image of the document is transmitted via mirror 24, lens 26, and mirror 28 in focus to an area 30 lying in the plane of the web 12. The original document could, of course, be a transparency illuminated from the back side thereof. The document D is illuminated, for example, four times to form four images of the document. On successive illuminations a red filter 32R, a green filter 32G, or a blue filter 32B is inserted into the light path to form color separation images at the area 30. A fourth filter comprising a neutral density filter 32N for providing what is known as a skeleton black image is inserted during a fourth exposure of the original. The timing of the flash of lamps 22 and the insertion of the colored filters are controlled by the logic and control unit L and related to the travel of the web 12 to expose adjacent, nonoverlapping areas of the web to the color separation images and the skeleton black image. One or more corona charging units, exemplified by corona charger 34, is located upstream of the exposure area 30, and applies a uniform electrostatic charge, of say negative polarity, to the web 12 as it passes the charger and before it enters the exposure area. The photoconductive properties of the web cause the uniform charge in the exposed areas of the web to be discharged in that portion struck by the exposure light. This forms latent imagewise charge patterns on the web in the exposed areas corresponding to the respective black and color separation images. Travel of the web then brings the areas bearing the latent images into a development area 36. The development area has a plurality of magnetic brush developer stations, corresponding to the number of formed black and color separation images, in juxtapostion to but spaced from the travel path of the web. The developer stations may be of the type described in U.S. Pat. No. 3,543,720 in the name of Drexler et al. When the color separation images are red, green, blue and a skeleton black image is also to be provided, there are four developer stations respectively containing complementary colored toner particles, i.e., cyan particles in station 36C, magenta particles in station 36M, yellow particles in station 36Y, and black particles in station 36B. The toner particles, which may be of the type described in U.S. Pat. No. 4,049,447 issued Sept. 20, 1977 in the name of Azar et al, are agitated in the respective developer stations to exhibit a triboelectric charge of opposite polarity to the latent imagewise charge pattern. Backup rollers 38C, 38M, 38Y, and 38B, located on the opposite side of web 12 from the development area, are associated with respective developer stations 36C, 36M, 36Y, and 36B. Actuators 40C, 40M, 40Y, and 40B selectively move respective backup rollers into contact with the web 12 to deflect the web from its travel path into operative engagement with respective magnetic brushes. The charged toner particles of the engaged magnetic brush are attracted to the oppositely charged latent imagewise pattern to develop the pattern.

The logic and control unit L selectively activates the actuators in relation to the passage of the image areas containing corresponding latent color separation images through the development area 36. That is, as the area containing the latent red color separation image reaches the developer station 36C, actuator 40C moves the backup roller 38C to deflect the web so that the latent charge image is developed by attracting cyan toner particles from the station 36C. As soon as the image area leaves the effective development area of the station 36C, the actuator 40C returns the backup roller 38C to its nondeflecting position. Thus, as the areas containing the green and blue color separation images and the neutral density latent image pass the developer station 36C, no development takes place. A similar cycle is accomplished by the logic and control unit L for the developer stations 36M, 36Y and 36B. In this manner, the red latent color separation image is developed only with cyan toner particles, the green latent color separation image is developed only with magenta toner particles, the blue latent color separation image is developed only with yellow toner particles, and the neutral density latent image is developed only with black toner.

The developed black and color separation images must be transferred to a receiver sheet in accurately registered superimposed relation to form a full color reproduction of the original document. Apparatus for providing such registered transfer is fully described in U.S. Pat. No. 4,251,154, issued Feb. 17, 1981 in the name of Matthew J. Russel the contents of which are incorporated herein by this reference.

After transfer of each of the four images to the receiver sheet, the receiver sheet is detacked from the web and moved along a path away from the web by a sheet transport apparatus such as, for example, a vacuum transport 60. The vacuum transport 60 delivers the sheet to a fixing apparatus, such as roller fuser 62. The transferred images are then fixed or fused onto the sheet and the sheet is then delivered to exit hopper 64. While the image is being fixed to the receiver sheet, the web 12 continues to travel about its path and proceeds through a cleaning area 66.

Figure 2:
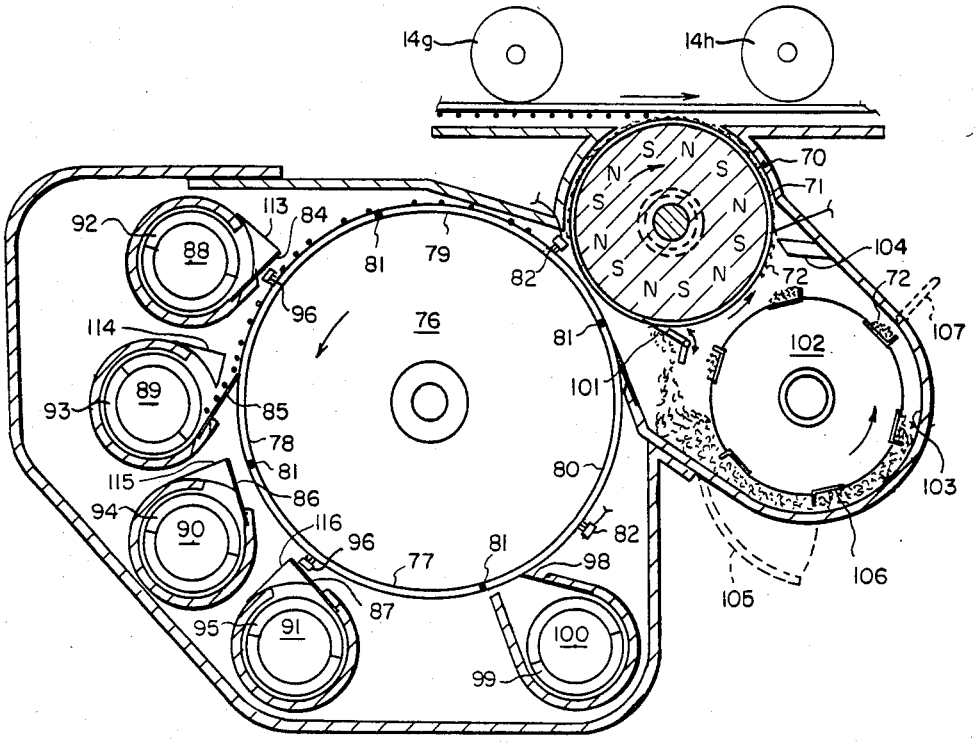
FIG. 2 is a schematic of a side elevational view of the cleaning apparatus shown in FIG. 1.

With reference now to FIG. 2, the cleaning area comprises a detoning magnetic cleaning brush 70. The brush has an outer cylinder or shell 71 driven in a counterclockwise direction and formed of a non-magnetic material; e.g., chrome, brass, aluminum, copper or stainless steel or a composite comprising a nonconductor, such as fiberglass, plated with one of the aforementioned materials. Conventional means (not shown) are provided for rotating the shell in the counterclockwise direction. The shell is spaced proximate to the photoconductor so that the nap formed by aligned magnetic carrier beads can fill the small gap or nip region between the photoconductor and the shell. Arranged within the shell is a core comprising twelve permanent bar magnets 73, the magnets being mounted around the periphery of the core and adapted to rotate clockwise as a unit so that the bristles formed by the carrier beads 72 on the periphery of the shell are sufficiently active to remove substantially all of the residual toner particles from the web 12; of course, other suitable magnet arrangements may also be used and the core may be made stationary. As is known in the art, the movement of the carrier beads, in attempting to maintain alignment with the changing magnetic field, provides a scrubbing action on the web to cause removal of residual toner particles adhering thereto. Specifically, it is believed that upon entering the aforementioned nip region, the residual toner particles on the web are bombarded by the high velocity carrier particles in the magnetic brush nap. This bombardment mechanically exceeds the toner to photoconductor contact forces thus allowing the electrostatic field (between the grounded Q-layer of the web 12 and a negatively biased surface of the magnetic brush roller) to dominate causing the residual toner particles to migrate away from the web into the carrier particle nap of the magnetic brush. In the nap, triboelectric charging causes the toner particles to adhere to the rapidly moving carrier particles, thus providing for transport of the toner particles out of the nip region.

To facilitate toner removal from the web, a corona charging station 102 and a rear erase lamp 103 may be located upstream of the cleaning unit to neutralize any charge remaining on the web and thus reduce the adherence forces of the toner to the web. As a result of this treatment, the toner may be biased slightly electrically positive. In addition, as mentioned above, a source of D.C. bias in the Logic and Control Unit may be coupled to the shell 71 to bias same negatively to electrostatically attract the positively charged toner particles toward the shell. The bias voltage supplied to the shell of the magnetic brush roller should be between −50 volts and −300 volts, and −150 volts is used in this example. Once in the nap the non-magnetic toner particles are carried by the rotating shell towards a rotating detoning roller 76. Roller 76 is rotated counterclockwise by suitable means not shown and comprises preferably four conductive surfaces or segments 77, 78, 79 and 80, each electrically isolated from the other by suitable insulating spacers 81. The surface of detoning roller 76 is formed from a nod-magnetic conductive material such as aluminum with the spacers 81 formed of nonconducting phenolic strips sealed with an epoxy plastic sealant. The surface is then turned and polished so it is smooth. The conductive portion of the surface may also be formed of a composite such as fiberglass that is plated with a metal conductor. Electrical brushes 82 are provided as shown and connected to a D.C. bias source in the Logic and Control Unit of say −1000 volts. The electrical brushes 82 engage the surface of the detoning roller 76 to establish this bias on those sectors (or sector) that are at any time located proximate to the magnetic brush roller 71 and are thus within what may be referred to as a stripping area. The bias voltage supplied to the segmented detoning roller at the stripping area may be between −500 and −2000 volts or more and is preferably as noted above −1000 volts D.C. The higher negative charge on the detoning roller causes the positively charged toner particles to migrate across the gap between the respective roller surfaces and adjacent to the line of centers of the two rollers and to adhere to the detoning roller. Preferably, no more than a monolayer of toner is desired to be created on the detoning roller during movement through the stripping area. In this regard, it is preferred that the surface speed of the segmented detoning roller be at least equal to but no more than twice the average tangential velocity of the carrier particles on the shell 71. The velocity of the carrier particles will be a vector sum of the velocity of the shell plus the velocity of the carrier particles relative to the shell as they move to align themselves with the changing magnetic field. The surfaces of the detoning roller and the shell may be rotating either current or countercurrent to each other.

On the opposite side of the detoning roller there are located circumferentially spaced about the roller a series of four similar color collectors each having respective skiving blades 84, 85, 86 and 87 that are activated in turn to remove toner from the surfaces of the detoning roller 76. As described above, each color toner is serially applied on the web in locations associated with its respective image area. Thus, the residual toners are serially removed from the web by the magnetic brush roller. The different color toners are thereafter serially stripped from the magnetic brush roller onto the detoning roller and in turn removed by the respective skiving blades. The skiving blades may be situated about the periphery of the detoning roller in the same order of color in which they are provided at the developer station. That is moving counterclockwise the first skiving blade 84 is for removing yellow colored toner, the second 85 for magenta, the third 86 for cyan and the fourth 87 for black.

As may be noted from the positions of the blades in FIG. 2, the magenta colored toner removing blade 85 is positioned against the detoning roller to scrape toner from the surfaces of the latter. The other blades are shown abutting a respective contamination seal 113, 115 and 116 to seal respective toner collecting chambers 88, 90 and 91. Thus, during removal of toner particles of one color from the detoning roller, the collecting chambers for the other colors are sealed off from contamination by airborne toner particles of the one color. Within each collecting chamber there is provided a rotating helical conveyor or auger 92, 93, 94 and 95 for conveying toner of the respective color towards an axial end of the chamber. As may be noted from FIG. 2, each chamber housing cover substantially surrounds its respective helical conveyor. At the end of each chamber, a suitable apparatus may be provided for recirculating toner back to a respective developer unit 36Y, 36M, 36C and 36B. Toner recirculating apparatus are well known in the prior art; for example, see U.S. Pat. No. 3,788,454. In lieu of recirculating the toner automatically, a container may be provided for collecting toner from each chamber and this toner may be manually returned to the respective developing chamber.

The four points of skive contact, by the color specific skiving blades, on the detoning roller may be within a 90° arc on the detoning roller surface. In order to facilitate removal of toner by the skiving blades from the detoning roller the roller segment or segments adjacent the skiving blades (and falling within the 90° arc) are coupled to a D.C. biasing source in the Logic and Control Unit by engagement of the surface of the detoning roller with electrical brushes 96 so that throughout this region the segments are biased electrically positive to say +50 volts (ground potential to +100 volts is a preferred range) and thus tend to repel the positively charged toner particles from the detoning roller.

A fifth skiving blade 98 is associated with the detoning roller and is provided as a scavenger to remove any toner not removed by the other four blades. The fifth blade remains continuously against the detoning roller and thus helps keep to a minimum the contamination of the color collectors by toner of other colors. Any toner collected by this scavenger is moved by its respective auger 99 in chamber 100 to a collection sump (not shown). Where suitable, the differently colored toners collected by the scavenger may be used as black toner or mixed with black toner for reuse or where this is not suitable these toners may be disposed of.

A skiving blade 101 is also engaged with the magnetic brush roller to remove magnetic cleaning material (carrier beads) and any toner not stripped from this roller by the detoning roller. It may be desirable that this blade is made pivotable so that as a specific color is being stripped from the magnetic brush roller by the detoning roller the blade 101 is moved away from the rotating shell 71 so that more than one revolution of the shell of the magnetic brush roller will be provided for each color toner to be removed therefrom. These multiple revolutions allow toner particles that are not removed by the detoning roller during a first revolution to be allowed to be removed during succeeding revolutions. After a suitable number of revolutions of the shell of the magnetic brush roller, the number corresponding to the time interval for movement of an image frame of the photoconductor past the magnetic brush, the skiving blade 101 may be pivoted into engagement with the magnetic brush roller to remove any remaining material (carrier and toner) before the next image area on the photoconductor is presented to the cleaning station. After the interframe period the skiving blade 101 may be once again pivoted out of engagement with the magnetic brush to allow multiple revolutions of the magnetic brush roller past the stripping gap to cause toner of the respective color being removed from the photoconductor to be carried to the detoning roller 76. The skiving blade 101 is coupled to a mechanism for pivoting the blade in response to signals from the Logic and Control Unit L. This mechanism (not shown) may comprise a solenoid coupled to the Logic and Control Unit to pivot the blade out of engagement with the shell and a spring for pivoting the blade into engagement with the shell. Any toner and carrier material removed by skiving blade 101 will fall into a carrier mixture chamber 103 which is continuously mixed by suitable rotating mixing paddles (not shown) formed in the interior of carrier transport wheel 102. The wheel 102 comprises an open structure permitting magnetic carrier beads or material 72 to enter the inside portion thereof and to be worked back and forth by the mixing paddles located on the inside of the wheel 101 so that mixing occurs as the wheel is rotated. A wheel of this type is described in U.S. application Ser. No. 597,323, filed Apr. 6, 1984 in the names of Brian J. Joseph and Thomas K. Hilbert and entitled, Electrographic Development Apparatus Having A Ribbon Blender. The wheel 102 also includes a series of trays 106 located on its periphery to carry magnetic carrier beads 72 towards the magnetic cleaning brush. The magnetic carrier beads 72 are attracted to the magnetic brush and collect thereon for movement towards the nip formed between the brush and the photoconductor. A compacting skive 104 is provided spaced from the periphery of the brush shell 71 to smooth out and control the thickness of the carrier beads on the brush. The distance between the brush shell 71 and the compacting skive 104 is dependent upon carrier particle size to allow towers of such particles to form on the shell as a nap. The separations between the shell 71 and the photoconductor and the shell 71 and the detoning roller 76 are preferably set equal to but may be less than or greater than the distance between the compacting skive 104 and the shell 71.

As toner of varying colors will likely be mixed with the carrier in the carrier mixing chamber 103, periodically a carrier purge door 105 may be opened to remove the contaminated and/or worn carrier beads. A fresh supply of carrier beads may be introduced through a carrier loading door 107. Since any toner falling within the carrier mixture chamber can be subsequently picked up by the magnetic brush and eventually reach any of the collecting chambers 88-91 it comprises a potential source of contamination. Therefore, the frequency of change of the carrier beads should be adjusted to keep contamination to an acceptable level. In this regard, the removal of old carrier beads and introduction of new carrier beads may be made automatically in conjunction with the number of machine cycles or by use of suitable toner concentration monitoring equipment.

Figure 3:
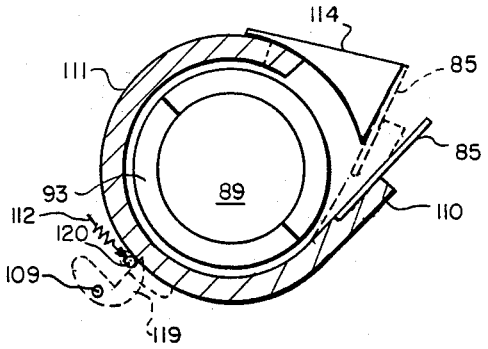
FIG. 3 is a schematic of a side elevational view of a portion of the cleaning apparatus shown in FIG. 2.

With reference now to FIG. 3, it will be noted that the collecting chambers of each of the color specific skiving blades (the magenta being the one illustrated) has a blade holder arm 110 that is part of container housing cover 111 which surrounds the auger 93. The blade is preferably made of non-magnetic stainless steel and may be attached to the arm by double sided tape which as an electrical insulator insulates the arm from any electrical bias on the blade. The entire housing cover is made pivotable about is central axis so that when pivoted as shown in dotted lines the blade will abutt against seal member 114 which does not pivot with the housing cover. During the predetermined time period when blade 85 is needed to remove magenta toner from the detoning roller 76, a rotary solenoid 109 is energized by Logic and Control Unit L to drive a lever arm 119 to pivot against a pin 120 attached to the housing cover 111 and cause the blade to be pivoted clockwise into engagement with the detoning roller. After a predetermined time interval based on the timing of the system, the solenoid is de-energized and a spring 112 returns the blade 85 into engagement with the seal member 114. The actuations of the color specific skiving blades are controlled so that the toner is removed from the detoning roller in the order in which the colors were placed on the photoconductor; i.e., yellow is removed first and black is removed last. The copier may be designed such that for certain copies only one color is used or more than one but less than four colors are used. In such case the Logic and Control Unit L is programmed to cause actuation of only those skiving blades associated with the colors so selected. While each color specific blade is removing its respective color toner from the detoning roller the others are cooperating to seal their respective toner collecting chambers to minimize cross-contamination of the toners or colorants. The various mechanical members shown such as skiving blades, collecting chambers, contamination seals, rollers, augers and trays extend for the full width of the web 12.

Modifications may include providing means for cleaning the blades as they are moved into or are already positioned into their container closing position. Thus, means may be provided to move the seal members 113–116 radially so that when moved to the position shown in FIG. 3 they wipe any toner remaining on the edge of the blade into the respective collecting chamber.

A detoning belt may be substituted for the detoning roller and supported adjacent the magnetic brush roller. The configuration of the belt could be designed to follow a portion of the contour of the magnetic brush roller and as such increases proximity time of the belt near the magnetic roller providing for more efficient detoning of the magnetic roller. The detoning roller or belt also may be divided into multiple surfaces one reserved for each colorant so that for each specific surface of the detoning roller only one color colorant will ever be used for detoning its specific color from the magnetic roller.

Further modifications may comprise the use of one skiving blade or element for stripping all the colors from the detoning roller and having the various collecting chambers rotate into position for collecting the respective colorant. Chambers not currently collecting colorant would be sealed by a flap that may be pivoted over the chamber opening in response to movement of the chamber away from its collecting position.

The preferred embodiment has been described with reference to a web or belt-like photoconductor. The invention, however, has utility with other photoconductors including sheet and drum photoconductors. The orientation of the photoconductor and the cleaning station vis-a-vis gravity may be other than that illustrated herein. Additional photoconductor cleaning means such as brushes may be provided to ensure appropriate removal of residual toner. The toner collected by these additional cleaning means may be commingled and mixed with black toner or disposed of.

Another possible source of a small amount of contamination of colors is in the transfer process where after transfer of one color toner to a receiver such as plain paper the paper when brought into engagement with the photoconductor to transfer the next or second color may lose some of the first color toner to the frame on the photoconductor containing the second color toner. As the photoconductor is cleaned of residual toner the small amount of toner of the first color impressed on the photoconductor by the paper will be collected in the chamber for collecting the second color. However, this small amount of contamination can be kept to acceptable low levels by for example continuously adding some "new" toner to "old" toner before recirculating same to the developing station.

The preferred embodiment has also been described with reference to a two-component developer employing a magnetic carrier and non-magnetic colorant or toner particle. Single component developers are known using magnetic toners or colorants and the invention has utility with these as well. With the use of such developers the respective color skiving blades may be operated directly against the photoconductor for removing the residual developer therefrom and directing same into the color specific collecting chambers.

The invention has been described in detail with particular reference to a preferred embodiment thereof. However, it will be understood that variations and modifications can be effected within the spirit and scope of the invention.

What is claimed is:

1. In a cleaning apparatus for removing colorant adhered to a surface, the apparatus including a plurality of skiving means each associated with the removal of colorant of a respective color from said surface, means for sequentially advancing each skiving means into engagement with the surface to remove colorant of the respective color therefrom and for maintaining the other skiving means associated with the removal of colorants of other colors not currently being removed from said surface out of engagement with the surface; plural collecting means one of each associated with a respective one of said skiving means for collecting the colorant of a respective color removed by the respective skiving means; and the improvement which comprises:

means for sealing each of said collecting means when its respective skiving means is out of engagement with the surface to block colorant of a different color than that associated with said collecting means from being collected by said collecting means while said colorant of a different color is being removed by one of said skiving means and collected by its respective collecting means.

2. The apparatus of claim 1 wherein the collecting means comprises a rotating helical conveyor; means defining a chamber substantially surrounding said conveyor and including an arm moveable into respective positions for opening and closing of the chamber; means for securing said skiving means to the arm; and wherein the advancing means moves the arm to a first position to open the chamber and place the skiving means in engagement with the surface and moves the arm to a second position to close the chamber and place the skiving means out of engagement with the surface.

3. The apparatus of claim 2 wherein the colorant is electrostatically charged to one polarity and means for electrically biasing the surface where engaged by the skiving means to an opposite polarity to facilitate removal of the colorant from the surface.

4. The apparatus of claim 3 and including photoconductor cleaning means for removing colorant from a photoconductor before the colorant is removed by the skiving means from the surface.

5. The apparatus of claim 4 and including means for moving the surface proximate the photoconductor cleaning means and means for electrically biasing the surface to a polarity for attracting colorant to move from the photoconductor cleaning means to the surface.

6. The apparatus of claim 5 wherein the photoconductor cleaning means is a magnetic brush.

7. The apparatus of claim 6 wherein the colorant is comprised of nonmagnetic toner particles and magnetic carrier particles are carried at the periphery of the magnetic brush for removing toner particles from the surface of the photoconductor.

8. In a polychromatic electrophotographic reproduction apparatus, a cleaning apparatus for removing residual toner particles from one or more photoconductors having respective image areas each containing residual toner particles of a respective color and whose areas are serially delivered to the cleaning station, the apparatus including:

first means for removing toner particles from the image areas as they serially pass through the cleaning apparatus;

second means for serially removing toner particles of different colors from the first means said second means including plural collecting means each for collecting toner particles of a respective color after the respectively colored toner particles are serially removed from the first means; and said second means further including sealing means substantially blocking toner-entrained air from carrying toner particles of a color being removed from said first means to deposit in collecting means for collecting toner particles of other respective colors.

9. The apparatus of claim 8 wherein the second means means further comprises:

means defining a toner collecting chamber for each of said collecting means; and a movable skiving blade means cooperating with each of said collecting means for removal of toner particles of a respective color from the first means and for guiding the toner particles of the respective color to a respective toner collecting chamber for collecting toner particles of such color; and wherein the sealing means each comprise:

a member movable into respective positions for opening and closing of the chamber; and advancing means for moving the member to a first position to open the chamber and place the skiving blade means in engagement with the first means and for moving the member to a second position to close the chamber and move the skiving blade out of engagement with the first means.

10. The apparatus of claim 9 wherein the first means comprises:

magnetic brush means including a nap of magnetic particles for removing residual toner particles from the one or more photoconductors, and detoning means having a surface portion movable proximate to the magnetic brush means for removing toner particles from the magnetic brush means.

11. The apparatus of claim 10 wherein the toner particles are charged to one polarity and including first biasing means for electrically biasing the surface portion of the detoning means to a polarity for attracting toner particles to move from the magnetic brush means to the surface portion.

12. The apparatus of claim 11 and wherein the skiving blade means engages said surface of said detoning means to remove toner particles therefrom and second biasing means for electrically biasing the surface, when at a location proximate the skiving blade means, to a polarity for repelling toner particles from the surface onto the skiving blade means.

13. The apparatus of claim 12 wherein the detoning means comprises a plurality of moving surfaces electrically insulated from each other and said first and second biasing means electrically bias each of said surfaces such that when any one surface of said surfaces is proximate the magnetic brush means the said one surface is biased electrically to attract toner particles from the magnetic brush and another one surface of said surfaces is simultaneously proximate the skiving blade and is biased electrically to repel toner particles from the said another one surface to the skiving blade means.

14. The apparatus of claim 13 and wherein the skiving blade means comprises plural skiving blades each cooperating with but one respective collecting chamber to remove toner particles of a respective color from the surfaces of said detoning means.

15. The apparatus of claim 14 and including means for driving the detoning means to cause each of said surfaces thereof to make a pass past said magnetic brush means and said skiving blade means for each color of toner particles to be removed from said one or more photoconductors and said first means including scavenger means for removing toner particles from said surfaces that are not removed by said skiving blade means.

16. In an electrostatographic reproduction apparatus for making polychromatic reproductions on receiver sheets of color information, including means for forming related discrete, transferable color images with electroscopic toners in serially spaced areas on a moving transfer member, means for transferring the related images from the transfer member onto a receiver sheet in superposed relation to form the polychromatic reproduction, means for removing residual toners remaining on the transfer member following transfer of the related images and collecting means having access openings for individually collecting by color, without substantially comingling of colors, the removed residual toners, the improvement comprising:

means operatively associated with the removing means for selectively closing said openings; and, control means responsive to and operating in synchronism with the movement of said areas into proximity with said removing means for closing all of said openings, except that opening through which passes toner of the color then on the area proximate to said removing means.

17. The apparatus of claim 16 and wherein said collecting means includes means for returning individually collected toners to said forming means for reuse.

18. In an apparatus for cleaning serially deposited residual electrostatographic toners of discrete colors from serially spaced areas on a moving surface and including means for individually collecting, without substantially comingling colors, the colored toners from such surface areas, said collecting means having access openings through which toners pass during collection, the improvement comprising:

means operatively associated with the collection means for selectively closing said openings; and control means responsive to and operating in synchronism with the movement of said areas into proximity with said collecting means for closing all of said openings, except that opening through which passes toner of the color then on the area proximate to said collecting means.

19. In a method for removing differently colored colorants adhered to a surface and collecting the colorants in respective collecting chambers, the method including the steps of advancing in turn each of several elements into engagement or proximity with the surface so that each removes a respective colorant from the surface, maintaining these elements associated with colorants not currently being removed out of engagement or proximity with the surface; collecting colored colorants in the respective collecting chambers as the colorants are each being removed by the respective elements; and the improvement which comprises:

sealing each of said collecting chambers when its respective element is out of engagement or proximity with the surface to block colorant of a color not to be collected in said collecting chamber from being collected by said collecting chamber while colorant of a different color is being removed by one of said elements and collected by its respective collecting chamber.

20. The method of claim 19 and including the steps of charging the colorants to one polarity and electrically biasing the surface where engaged by or in proximity to the elements to an opposite polarity to facilitate removal of the colorants from the surface.

21. The method of claim 20 and including the step of removing the colorants from a photoconductor before the colorants are removed by the elements from the surface.

22. The method of claim 21 and including the step of placing the colorants upon the surface after removal from the photoconductor by electrically biasing the surface to the opposite polarity as the colorants for attracting the colorants to the surface.

23. In a method for removing differently colored colorants adhered to a surface and for collecting the colorants in respective collecting chambers, the method including the steps of serially removing the colorants one color at a time from the surface and collecting the colorants by color, without substantial commingling of colors, in respective collecting chambers as each color is in turn removed from the surface; the improvement which comprises:

sealing each of the other collecting chamber(s) when their respective colored colorant(s) are not being currently removed from the surface and when a colorant of another color is being removed from the surface and collected by its respective collecting chamber to block such colorant of another color from being collected by said other collecting chamber(s).

24. The method of claim 23 and including the steps of electrostatically charging the colorants to one polarity and electrically biasing the surface from where the colorant is being removed to the same polarity to facilitate removal of the colorants from the surface.

25. The method of claim 24 and including the step of removing the colorants from a photoconductor before the colorants are removed from the surface.

26. The method of claim 25 and including the step of placing the colorant upon the surface after removal from the photoconductor by electrically biasing the surface to an opposite polarity as the colorants for attracting the colorants to the surface.

27. A method of cleaning residual particulate color toners remaining on serially spaced areas on a moving transfer member following transfer of color toner images from such areas, which method comprises:

removing the residual color toners sequentially from the spaced areas;

collecting the removed toners in individual receptacles; and closing off all of the receptacles except the one receptacle containing the color toner then being currently removed to prevent contamination, by toner being currently removed, in the closed off receptacles.

* * * * *